US010102999B2

(12) United States Patent
Gorrilla

(10) Patent No.: US 10,102,999 B2
(45) Date of Patent: Oct. 16, 2018

(54) ASYMMETRIC CORE QUADRUPOLE WITH CONCAVE POLE TIPS

(71) Applicant: General Electric Company, Schenectady, NY (US)

(72) Inventor: Michael William Gorrilla, West Milwaukee, WI (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 227 days.

(21) Appl. No.: 15/084,888

(22) Filed: Mar. 30, 2016

(65) Prior Publication Data

US 2017/0287672 A1 Oct. 5, 2017

(51) Int. Cl.
*H01J 35/14* (2006.01)
*H05G 1/02* (2006.01)

(52) U.S. Cl.
CPC ..... *H01J 35/14* (2013.01); *H05G 1/02* (2013.01)

(58) Field of Classification Search
CPC ..... H01J 35/14; H01J 35/30; H01J 2235/086; H01J 35/06; H01J 35/16
See application file for complete search history.

(56) References Cited

U.S. PATENT DOCUMENTS 4,885,500 A 12/1989 Hansen et al.
8,975,368 B2 3/2015 Kulp, III et al.
2016/0268095 A1* 9/2016 Canfield ..... H01J 35/14

* cited by examiner

*Primary Examiner* — Don Wong

(57) ABSTRACT

A magnetic assembly for focusing an electron beam includes one or more quadrupole assemblies, each quadrupole assembly having at least a pair of separate opposing members with angular pole extensions of one opposing member facing angular pole extensions of another opposing member. An X-ray tube includes a magnetic assembly for focusing an electron beam extending from a cathode to an anode of the X-ray tube, the magnetic assembly comprising one or more quadrupole assemblies, each quadrupole assembly having at least a pair of opposing members with angular pole extensions of one opposing member facing angular pole extensions of another opposing member.

16 Claims, 7 Drawing Sheets

ASYMMETRIC CORE QUADRUPOLE WITH CONCAVE POLE TIPS

FIELD

The disclosed exemplary embodiments relate generally to X-ray generation, and more particularly to structures within an X-ray tube.

BACKGROUND

X-ray tubes may be used in a variety of applications to scan and reconstruct one or more images of an object. For example, in computed tomography (CT) imaging systems an X-ray tube may be part of an X-ray source that emits a fan or cone shaped beam toward an object. A typical object may include a patient, a patient's body part, a package, a piece of baggage, a manufactured component, or other object to be scanned. The X-ray beam is attenuated by the object and impinges upon a detector array. Each detector element of the detector array produces an electrical signal indicative of the attenuated beam received by the individual detector element. The electrical signals are transmitted to a data processing system for generating images of the object and for additional analysis.

In some computed tomography imaging systems, the X-ray source and the detector array are rotated about a gantry around the object. The detector array may include a collimator for collimating X-ray beams received at the detector, a scintillator disposed adjacent to the collimator for converting X-rays to light energy, and photodiodes for receiving the light energy from the adjacent scintillator and producing electrical signals.

FIG. 1 shows a diagram of an X-ray tube assembly 100. The X-ray tube assembly 100 may include a filament or emitter 120 and an anode 116. The filament or emitter 120 produces an electron beam 102 that impinges on anode 116 to produce an X-ray beam 180.

The filament or emitter 120 may be part of a cathode assembly 110, including cathode assembly shield 114 enclosing the filament or emitter 120, and a series of electrodes including a focusing electrode 130, an extraction electrode 140, and a downstream focusing electrode 150. The filament or emitter 120 may be heated, for example, by passing a relatively large current through the filament or emitter 120. A voltage source 124 may supply this current to the filament or emitter. A potential difference may be applied between the cathode assembly 110 and anode 116, otherwise known as a target, to accelerate the electron beam 102 from the filament or emitter 120 toward the anode 116. An exemplary potential difference within a range from about 40 kV to about 450 kV may be applied using a high voltage feedthrough 126 to set up a potential difference between the cathode assembly 110 and the anode 116.

In some embodiments, one or more portions of each of the electrodes 130, 140, 150 may be maintained at static or variable voltage potentials in order to focus the electron beam 102. A flow of electrons in the electron beam 102 from the filament or emitter 120 toward the anode 116 may be controlled by altering the voltage potential of one or more portions of the electrodes 130, 140, 150. In some embodiments, the size (e.g., width, diameter, cross-sectional area) and the intensity of the electron beam 102 may also be controlled by altering the voltage potential of one or more portions of the electrodes 130, 140, 150.

The X-ray tube 100 also includes a magnetic assembly 160 for focusing or positioning and deflecting the electron beam 102 on the anode 116. The magnetic assembly 160 may be generally disposed between the cathode assembly 110 and the anode 116. The magnetic assembly 160 generally includes magnets 162 for influencing focusing and or deflection of the electron beam 102 by creating a magnetic field that shapes and or deflects the electron beam 102 on the anode 116. The magnets 162 may include a cathode side quadrupole 162A and an anode side quadrupole 162B.

FIG. 2 shows an isometric illustration of the cathode side quadrupole 162A and the anode side quadrupole 162B. The cathode side quadrupole 162A has a core 200 with members 202, 204 extending along the Y-axis, and members 206, 208 extending along the X-axis, referred to as cross bars. Cross bars 206, 208 may each be separated by a gap 210, 212, respectively. The cathode side quadrupole 162A includes a plurality of poles with pole windings, referred to as QC windings 214, 216, 218, 220 connected in series. The polarities of the QC windings are arranged so that electrons are pushed into the YZ plane.

The target side quadrupole 162B similarly has a core 230 with members 232, 234 extending along the Y-axis, and members 236, 238 extending along the X-axis, also referred to as cross bars. Cross bars 236, 238 may each be separated by a gap 240, 242, respectively. The anode side quadrupole 162B includes a plurality of poles with pole windings, referred to as QT windings 244, 246, 248, 250 connected in series. The polarities of the QT windings are arranged such that electrons are pushed into the ZX plane. The anode side quadrupole 162B also has pole windings, also referred to as DY windings 252, 254, 256, 258 wound with the QT windings 244, 246, 248, 250 and independently connected in series. In addition, the anode side quadrupole 162B has windings mounted on the core, referred to as DX windings 260, 262 independently connected in series.

The QC windings 214, 216, 218, 220, and QT windings 244, 246, 248, 250 are used to focus the electron beam 102 (FIG. 1) and affect the focal spot size and shape. The DY windings 252, 254, 256, 258 and the DX windings 260, 262 are used for focal spot alignment and or deflection with the DY windings deflecting the focal spot in the +/−Y direction and the DX windings deflecting the focal spot in the +/−X direction.

The quadrupole configuration provides very precise control of the electron beam with relatively fast reaction times. As a result, X-ray tubes are increasingly becoming reliant on magnetic control of the x-ray producing electron beam for focusing and deflection. In addition, a higher density electron beam in the X-ray tube is advantageous for higher resolution images. Furthermore, computed tomography systems are running at higher gantry rotational speeds for more rapid image capture. There is a need for magnetic focusing and deflection systems that may accommodate a higher density electron beam and that require less material, less mass, and less power.

SUMMARY

According to at least one aspect of the disclosed embodiments, a magnetic assembly for focusing an electron beam includes one or more quadrupole assemblies, each quadrupole assembly having at least a pair of separate opposing members with angular pole extensions of one opposing member facing angular pole extensions of another opposing member.

Tips of the angular pole extensions may be concave.

Tips of the facing pole extensions may be equidistant from each other.

Angular pole extensions positioned at opposite ends of different opposing members may face each other.

The one or more quadrupole assemblies may include a first quadrupole assembly with windings on the angular pole extensions for focusing the electron beam in a first plane.

The one or more quadrupole assemblies may include a second quadrupole assembly with windings on the angular pole extensions for focusing an electron beam in a second plane, perpendicular to the first plane.

The second quadrupole assembly may further include windings for deflecting a focal spot of the electron beam in different directions.

The opposing members may be C shaped quadrupole cores with the angular pole extensions positioned at ends of the C shaped quadrupole cores.

The opposing members may be triangular quadrupole cores with truncated ends forming the angular pole extensions.

According to at least one other aspect of the disclosed embodiments, an X-ray tube includes a magnetic assembly for focusing an electron beam extending from a cathode to an anode of the X-ray tube, the magnetic assembly comprising one or more quadrupole assemblies, each quadrupole assembly having at least a pair of opposing members with angular pole extensions of one opposing member facing angular pole extensions of another opposing member.

Tips of the angular pole extensions may be substantially concave.

Tips of the facing pole extensions may be equidistant from each other.

Angular pole extensions positioned at opposite ends of different opposing members may face each other.

The one or more quadrupole assemblies may include a cathode side quadrupole with windings on the angular pole extensions of the cathode side quadrupole for focusing an electron beam in a first plane.

The one or more quadrupole assemblies may include an anode side quadrupole with windings on the angular pole extensions of the anode side quadrupole for focusing an electron beam in a second plane, perpendicular to the first plane.

The anode side quadrupole further comprises windings for deflecting a focal spot of the electron beam in different directions.

The opposing members may be C shaped quadrupole cores with the angular pole extensions positioned at ends of the C shaped quadrupole cores.

The opposing members may be triangular quadrupole cores with truncated ends forming the angular pole extensions.

BRIEF DESCRIPTION OF THE DRAWINGS

The foregoing and other aspects of the disclosed embodiments are made more evident in the following Detailed Description, when read in conjunction with the attached Drawing Figures, wherein.

DETAILED DESCRIPTION

The disclosed embodiments are directed to increasing quadrupole performance by providing a stronger magnetic field for a given number of amp-turns as well as producing a rounder field for a given amount of core material and amp-turns. Another aspect of the disclosed embodiments is a reduction in the required amount of core material needed produce adequate magnetic field strength and roundness for X-ray tube applications. A fundamentally more efficient magnet design allows the quadrupole magnet to be reduced in size resulting in smaller envelope requirements, less mass to move around the gantry, less overall x-ray tube weight, less cost and a rounder electron beam. The more efficient quadrupole magnet design also results in a reduction in power requirements and less waste heat needing to be removed from the magnet assembly, allowing cooling capacity to be used elsewhere on the x-ray tube assembly.

Figure 1:
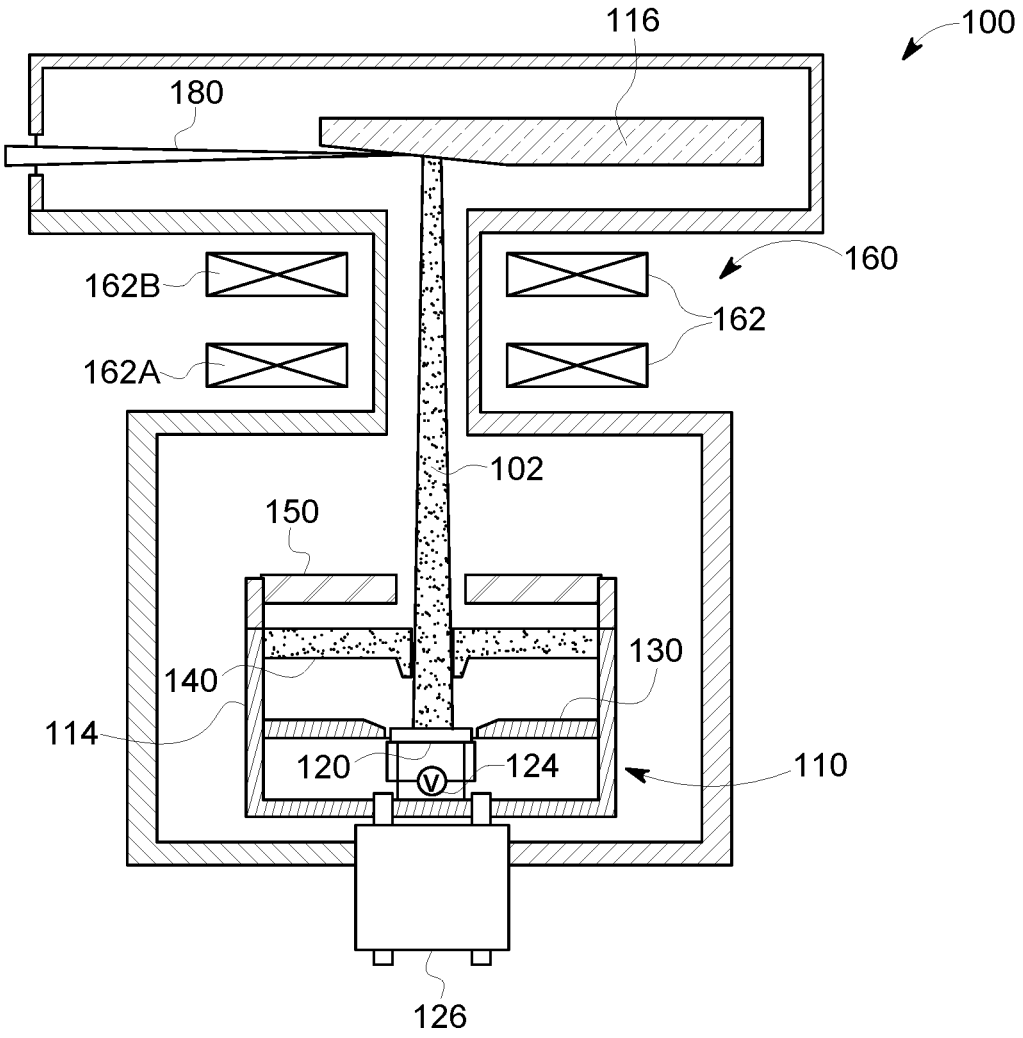
FIG. 1 shows a diagram of an X-ray tube assembly.
Figure 2:
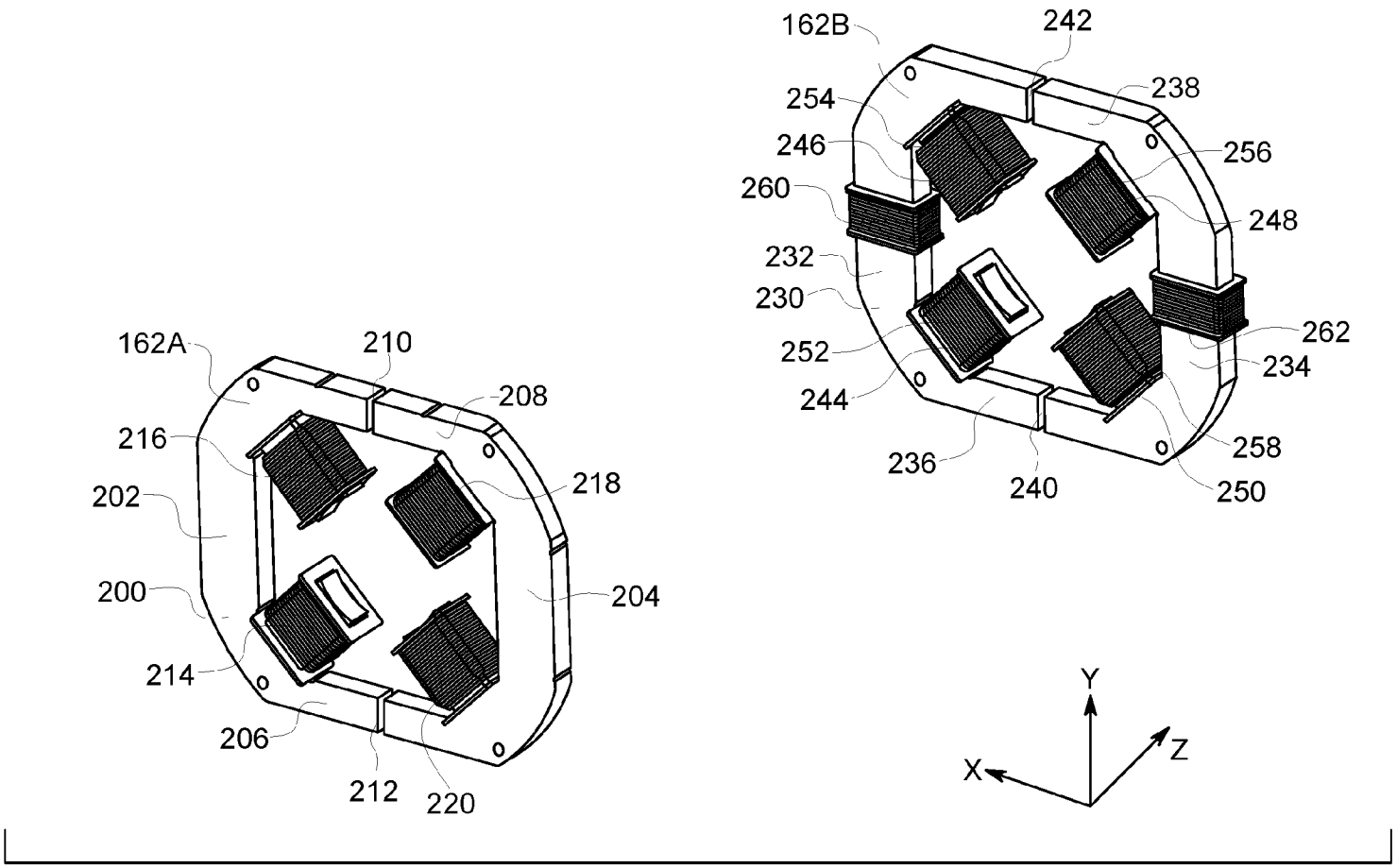
FIG. 2 shows an isometric illustration of cathode side and anode side quadrupoles.
Figure 3:
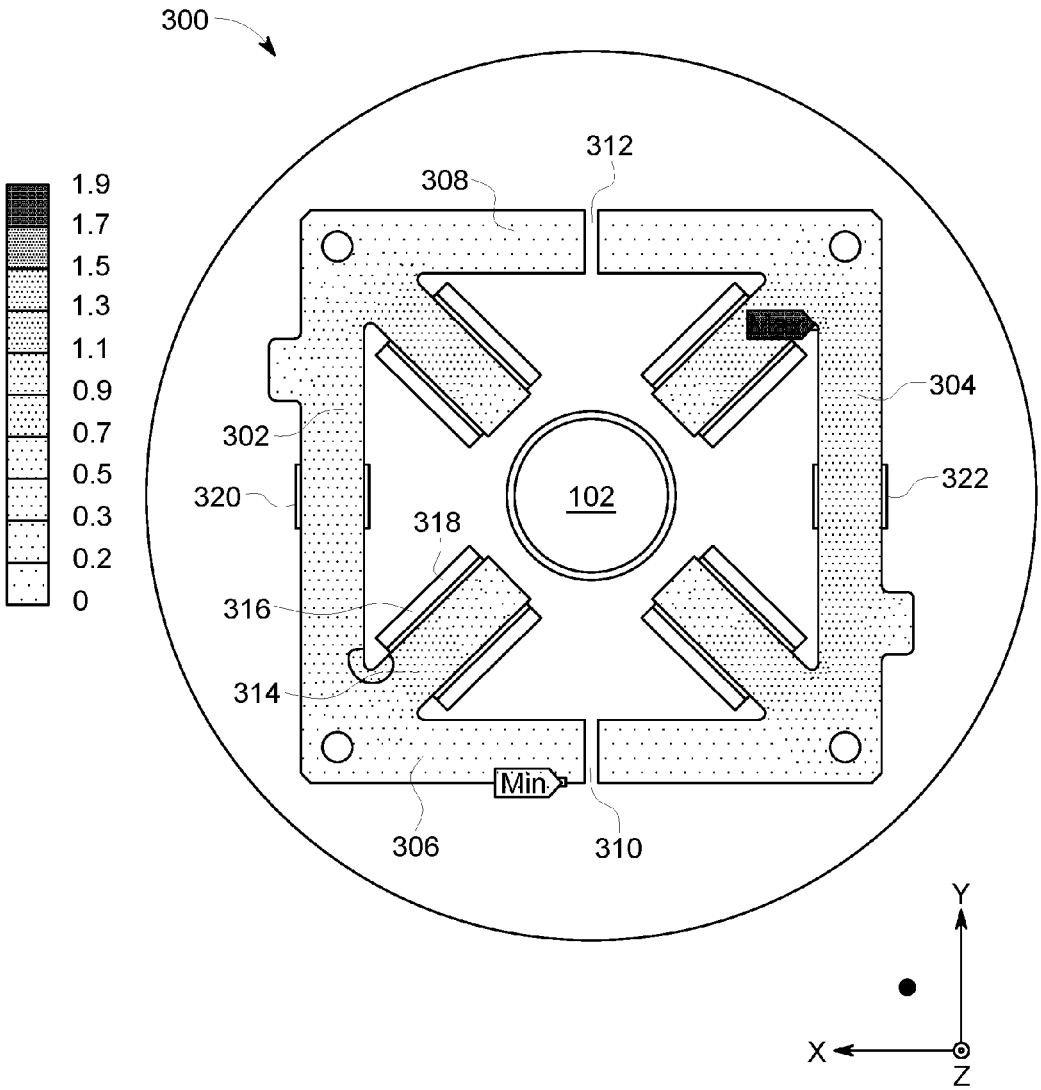
FIG. 3 shows a magnetic flux density map of a model of a typical quadrupole core.

A study was performed to determine if a standard quadrupole core could effectively control a higher density or larger electron beam by simply increasing current through the windings. FIG. 3 shows a magnetic flux density map of a model of a typical quadrupole core 300 for controlling the electron beam 102. The model quadrupole core 300 includes members 302, 304 extending along the Y-axis, and cross bar members 306, 308 extending along the X-axis. Cross bar members 306, 308 may each be separated by a gap 310, 312, respectively. The model quadrupole core 300 includes four poles 314, each with QT windings 316, and DY windings 318 wound on the poles 314. The model quadrupole core 300 also includes DX windings 320, 322 mounted on members 302 and 304.

It should be understood that the quantities and values disclosed throughout this application are examples only, are non-limiting, and are illustrative of approximate relative measurements. It should also be understood that each of the X, Y, and Z axes, as used to describe directions and orientation herein, may extend in any direction so long as they remain orthogonal to each other.

Figure 7:
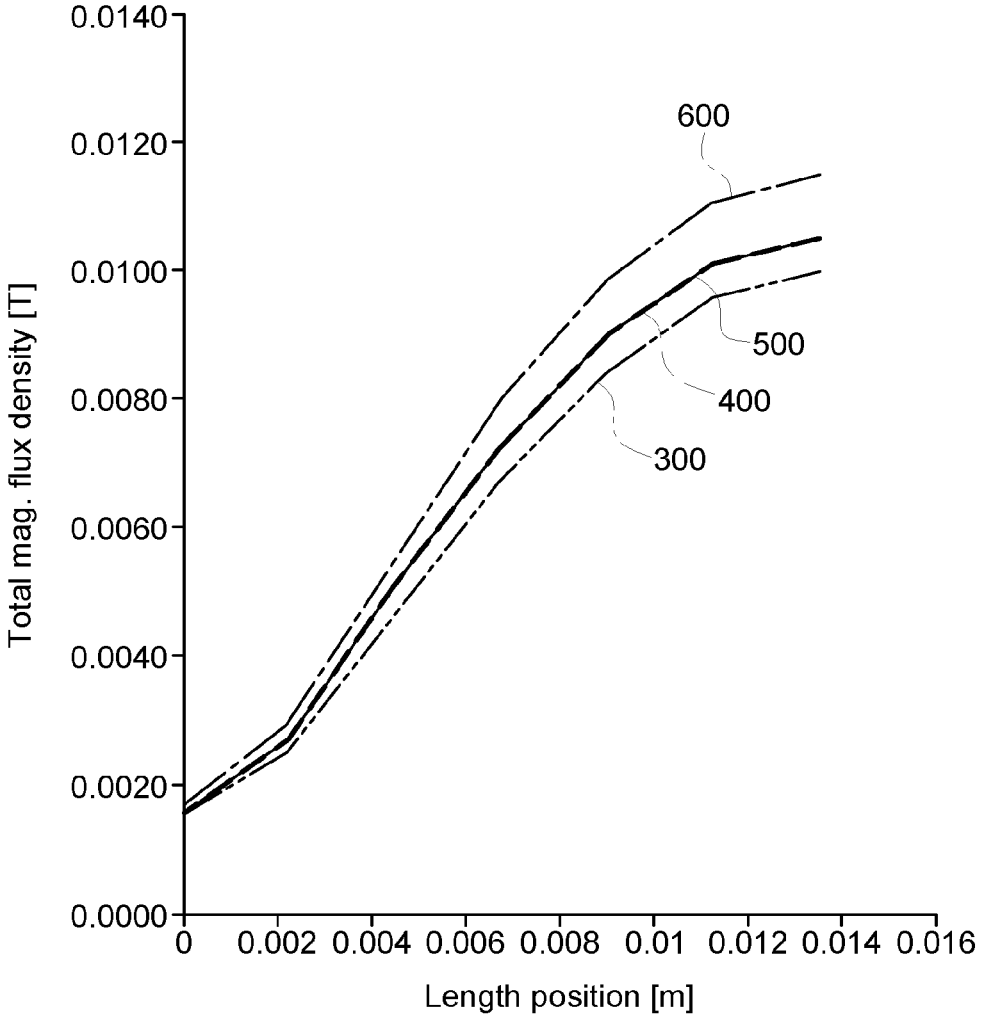
FIG. 7 shows a plot of magnetic flux density along an electron beam path for various disclosed embodiments.

In the model, typical currents are applied to the windings for controlling the electron beam 102. Exemplary approximate applied currents are QT=5.5 A, DY=2.1 A, and DX=1.3 A. Magnetic flux densities for this configuration under these conditions remain within typical design limits, for example, below 0.2 T (see the MIN tag) for the cross bar members 306, below 1.1 T for most core portions, with a maximum approaching 1.5 T along X-axis member 304 where the poles 314 begin to extend from the core 302 (see the MAX tag). Referring to FIG. 7, as modeled, the currents are able to produce a magnetic field in the model quadrupole core 300, for example, of approximately 0.01 T measured in the path of the electron beam approximately 13.6 mm along the Z-axis, offset approximately 5 mm from the X-axis.

Figure 4:
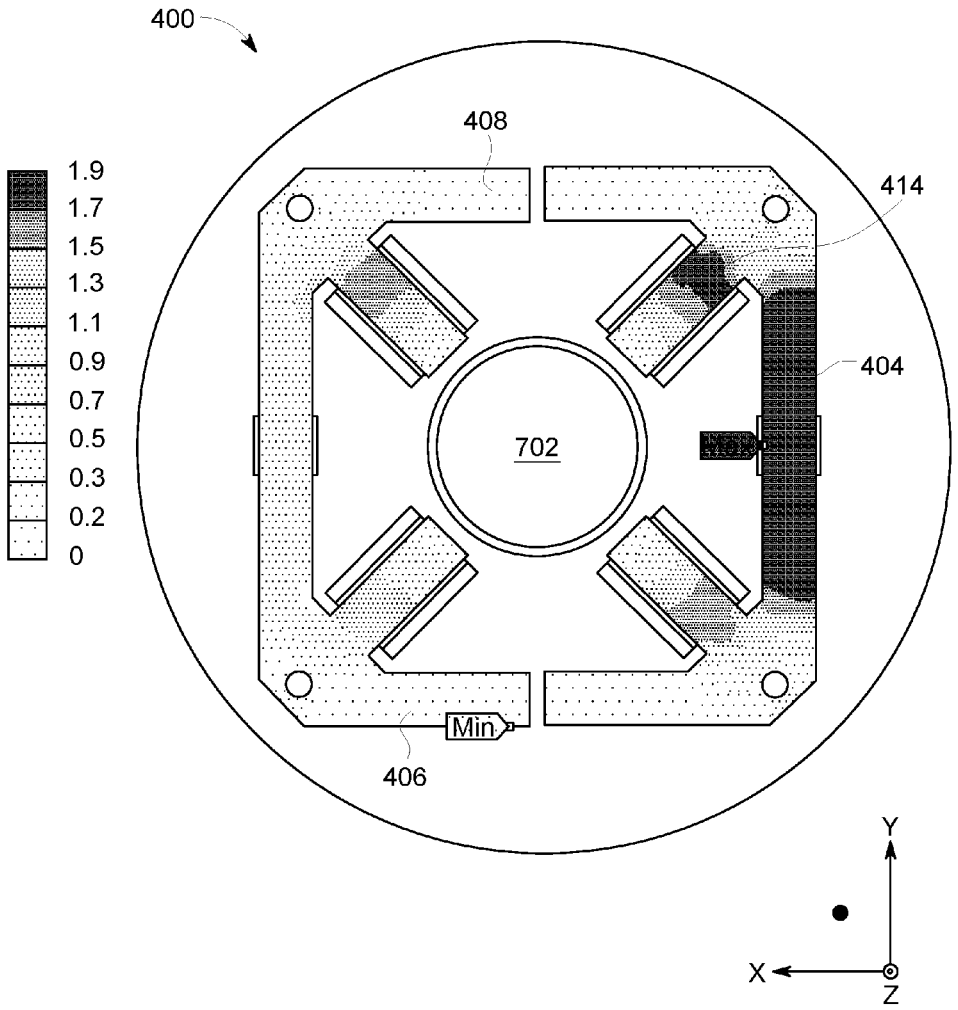
FIG. 4 shows a magnetic flux density map of a model of a modified quadrupole core.

FIG. 4 shows a magnetic flux density map of a model of a quadrupole core 400 where the currents applied to the windings have been increased to control a higher density or wider electron beam 702, where exemplary applied winding currents may be approximately QT=8.0 A, DY=3.0 A, and DX=1.9 A. The magnetic flux density exceeds 1.7 T and approaches saturation in the Y-axis member 404 and in pole tip 414, while the magnetic flux density in the cross bar members 406, 408 remains under 0.2 T. As shown in FIG. 7, the exemplary applied currents of QT=8.0 A, DY=3.0 A, DX=1.9 A are able to produce a magnetic field in the model quadrupole core 400, for example, of approximately 0.012 T measured in the path of the electron beam approximately 13.6 mm along the Z-axis, offset approximately 5 mm from the X-axis.

Figure 5:
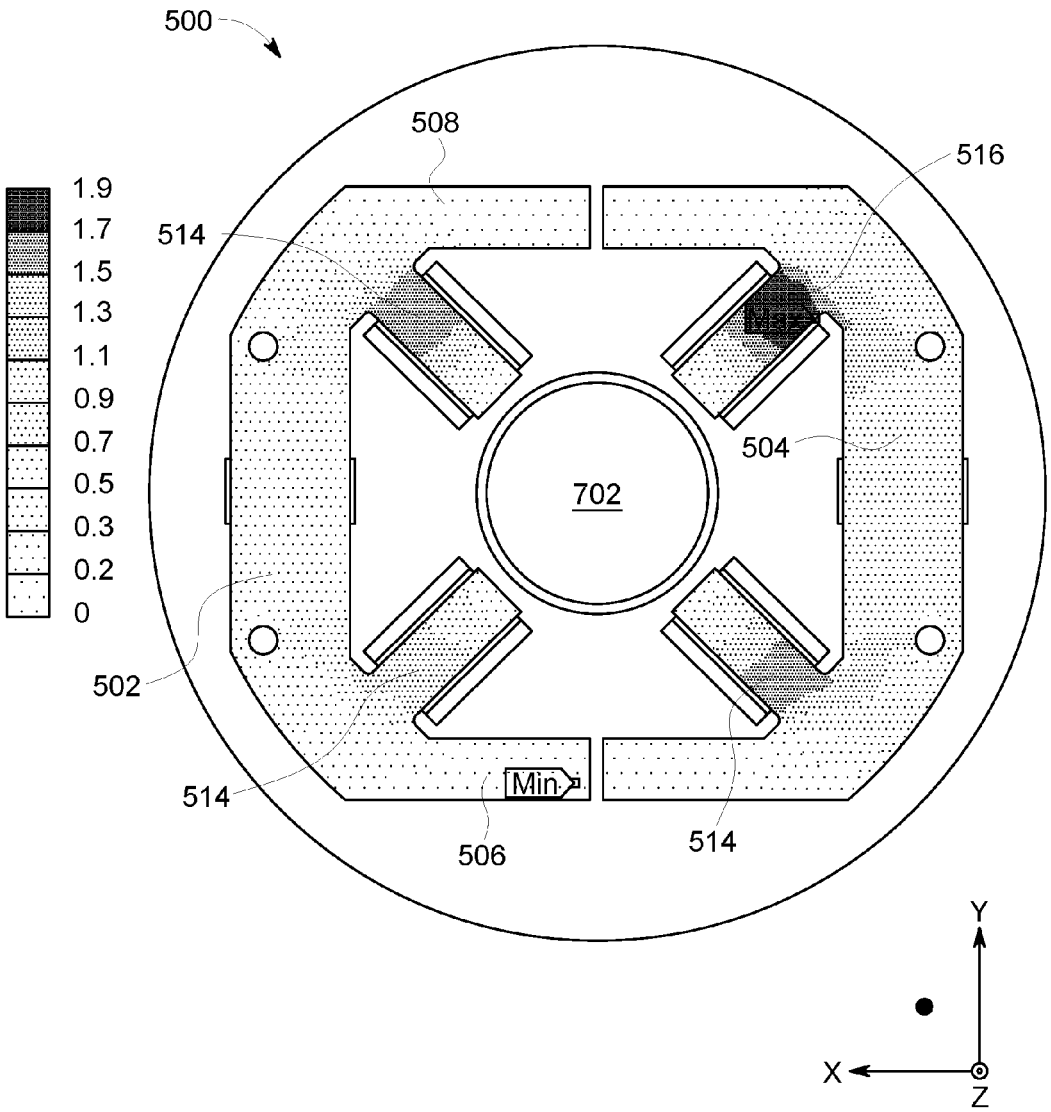
FIG. 5 shows a magnetic flux density map of a model of another modified quadrupole core.

FIG. 5 shows a magnetic flux density map of a model of a quadrupole core 500 where the cross sectional area of the Y-axis members 502, 504 have been increased to increase their flux carrying capacity, while the exemplary applied winding currents have been maintained at approximately QT=8.0 A, DY=3.0 A, and DX=1.9 A. Magnetic flux density for the quadrupole core 500 under these conditions remains below 0.2 T for cross bar members 506, 508, below 1.1 T for Y-axis members 502, 504, and approaches 1.5 T in some of the poles 514. Magnetic flux density in pole 516 generally exceeds 1.7 T and approaches saturation. As shown in FIG. 7, the exemplary currents of QT=8.0 A, DY=3.0 A, and DX=1.9 A applied to the quadrupole 500 are able to produce a magnetic field, for example, of approximately 0.012 T measured in the path of the electron beam approximately 13.6 mm along the Z-axis, approximately 5 mm offset from the X-axis in the model, similar to the exemplary embodiment 400 illustrated in FIG. 4.

It should be noted that in each quadrupole configuration 300, 400, 500, the magnetic flux density in the cross bar members 306, 308, 406, 408, 506, 508 remains below 0.2 T. Because the cross bars 306, 308, 406, 408, 506, 508 are subject to low magnetic flux density and changes in cross sectional area and curvature of other components of the quadrupoles 300, 400, 500 do not appear to affect the magnetic flux through the cross bar members 306, 308, 406, 408, 506, 508, the cross members have been removed for the embodiment shown in FIG. 6.

Figure 6:
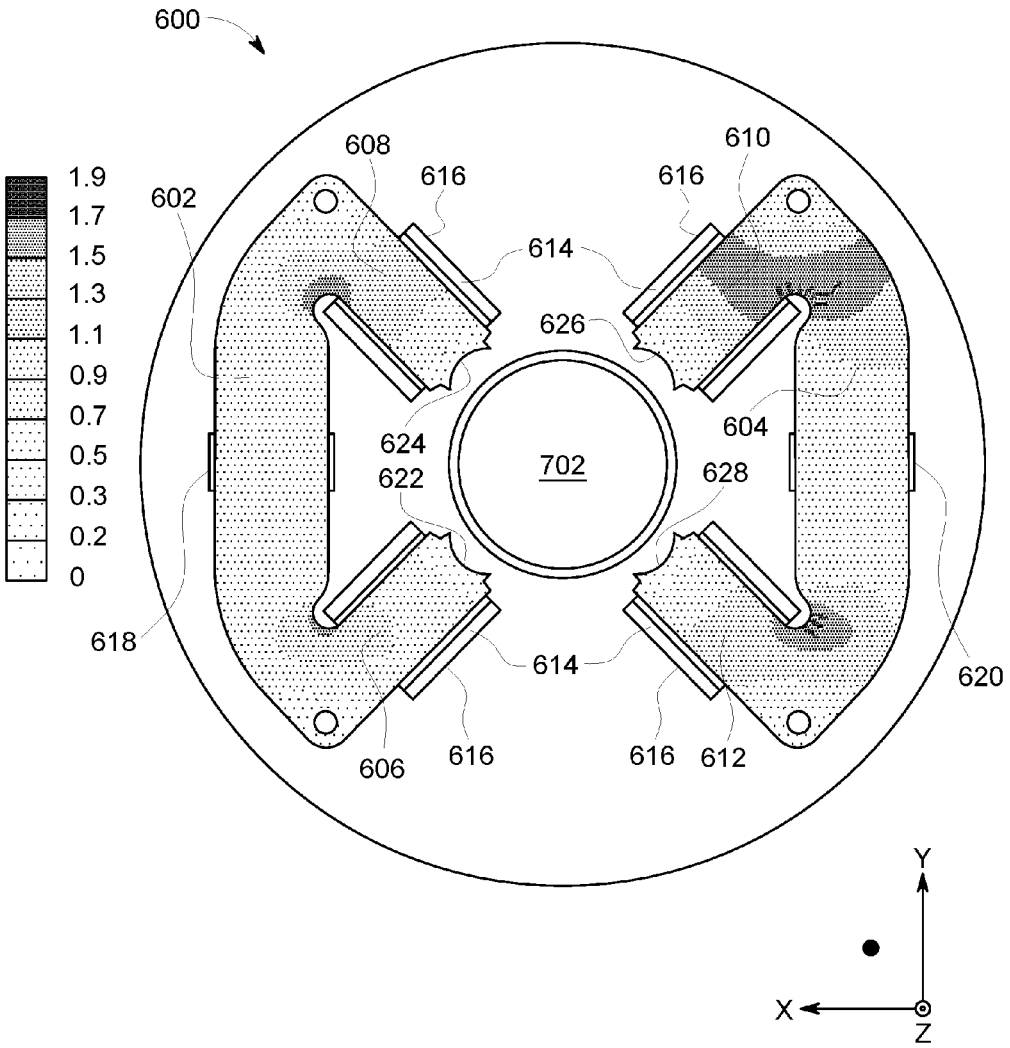
FIG. 6 shows a diagram of an exemplary fully discontinuous asymmetric quadrupole according to the disclosed embodiments.

FIG. 6 shows a diagram of an exemplary fully discontinuous asymmetric quadrupole 600 according to the disclosed embodiments. The quadrupole 600 includes a quadrupole core without cross bars, resulting in at least a pair of separate opposing members 602, 604 with angular pole extensions 606, 608 of one opposing member 602 facing angular pole extensions 610, 612 of the other opposing member 604. The lack of cross bars causes the opposing members to be magnetically discontinuous. The separate opposing members 602, 604 may extend in the Y-direction The separate opposing members 602, 604 may also be described as oppositely placed C shaped quadrupole cores 602, 604 with opposing angular extending poles 606, 608, 610, 612 positioned at the ends of the C shaped cores 602, 604. In some embodiments, the opposing members 602, 604 may be described as opposing triangular quadrupole cores with truncated ends forming the angular pole extensions 606, 608, 610, 612, where poles at opposite ends of opposing members extend toward each other. The oppositely placed C shaped quadrupole cores and the opposing triangular quadrupole cores may extend in the Y-direction.

As mentioned above, the angular extending poles positioned at opposite ends of the opposing C shaped cores may face each other, for example, poles 606 and 610 may face each other, as well as poles 608 and 612. In more detail, pole 606 on member 602 may face pole 610 on an opposite end of opposing member 604. Correspondingly, pole 612 on member 604 may face pole 608 on an opposite end of opposing member 602. In one or more embodiments, tips of facing poles may be substantially equidistant. For example, each pole 606, 608, 610, 612 may have a corresponding pole tip 622, 624, 626, 628, respectively. The distance between pole tips 622 and 626 may be the same as the distance between pole tips 624 and 628.

The fully discontinuous asymmetric quadrupole 600 may be configured as a anode side quadrupole and may have QT windings 614 wound on each pole 606, 608, 610, 612 and DY windings 616 wound on each pole 606, 608, 610, 612. The polarities of the QT windings may be arranged such that electrons are pushed into a plane, for example, the ZX plane. In addition, when configured as a anode side quadrupole, the fully discontinuous asymmetric quadrupole 600 may also have windings mounted on the core, referred to as DX windings 618, 620 connected in series. The DY and DX windings may operate to deflect the electron beam focal spot in different directions. For example, the DY windings may deflect the focal spot in the +/−Y direction and the DX windings may deflect the focal spot in the +/−X direction. In one or more embodiments, the fully discontinuous asymmetric quadrupole 600 may be configured as a cathode side quadrupole and may have QC windings wound on each pole 606, 608, 610, 612. The polarities of the QC windings may be arranged so that electrons are pushed into a plane perpendicular to the plane into which the QT windings push electrons, for example, the YZ plane.

The magnetic flux density map of FIG. 6 represents the different flux densities for applied winding currents of approximately QT=8.0 A, DY=3.0 A, and DX=1.9 A. Magnetic flux density for the fully discontinuous asymmetric quadrupole 600 under these conditions remains below 1.1 T for Y-axis members 602, 604, and approaches 1.5 T in the poles 606, 608, 610, 612, in particular at angular bends at the base of the poles 606, 608, 610, 612. Referring to FIG. 7, the exemplary currents of QT=8.0 A, DY=3.0 A, and DX=1.9 A applied to the fully discontinuous asymmetric quadrupole 600 are able to produce a magnetic field, for example, of approximately 0.0165 T measured in the path of the electron beam approximately 13.6 mm along the Z-axis, approximately 5 mm offset from the X-axis. Thus, the fully discontinuous asymmetric quadrupole 600 advantageously produces a more intense magnetic field from the same amount of current than previous designs without saturating the core material.

In one or more embodiments of the fully discontinuous asymmetric quadrupole 600, the pole tips 622, 624, 626, 628 may be substantially concave, as shown in FIG. 6. The concave quadrupole pole tips 622, 624, 626, 628 may generate a stronger magnetic field for electron beam focusing and deflection by concentrating and focusing magnetic flux within the region of the electron beam 702. The concave quadrupole pole tips 622, 624, 626, 628 are particularly useful when the electron beam 702 is nearly circular because the effective pole to pole spacing is reduced which increases field strength for a given number of amp-turns. The pole tips 622, 624, 626, 628 may each have concave circular arcs which are concentric with the electron beam 702. It should be understood that the pole tips 622, 624, 626, 628 may be implemented with any suitable form of concavity, including for example, curved, circular, parabolic, straight line, or other sections, so long as the resulting shape is substantially concave. Since magnetic flux tends to exit core geometries normal to the surface, the concave pole tips operate to focus the magnetic flux into the electron beam 702.

The fully discontinuous asymmetric quadrupole 600 produces the necessary field strength and shape for various quadrupole focusing and deflection applications with significantly less material. In addition, by guiding all or the majority of the magnetic flux to the electron beam region and eliminating the magnetic flux path through the cross bar members and gap between the X-axis members, the fully discontinuous asymmetric quadrupole 600 tends to generate a more repeatable magnetic field from assembly to assembly as the gap and dimensional variation between the Y-axis members impacts the effective core resistance across the gap, which in turn, impacts the field strength acting on the electron beam.

Various modifications and adaptations may become apparent to those skilled in the relevant arts in view of the foregoing description, when read in conjunction with the accompanying drawings. However, all such and similar modifications of the teachings of the disclosed embodiments will still fall within the scope of the disclosed embodiments.

Furthermore, some of the features of the exemplary embodiments could be used to advantage without the corresponding use of other features. As such, the foregoing description should be considered as merely illustrative of the principles of the disclosed embodiments and not in limitation thereof.

What is claimed is:

1. A magnetic assembly for focusing an electron beam comprising:

one or more quadrupole assemblies, each quadrupole assembly having at least a pair of opposing members with angular pole extensions of one opposing member facing angular pole extensions of another opposing member, wherein tips of the angular pole extensions are substantially concave.

2. The magnetic assembly of claim 1, wherein tips of the facing pole extensions are substantially equidistant from each other.

3. The magnetic assembly of claim 1, wherein angular pole extensions positioned at opposite ends of different opposing members face each other.

4. The magnetic assembly of claim 1, wherein the one or more quadrupole assemblies includes a first quadrupole assembly with windings on the angular pole extensions for focusing the electron beam in a first plane.

5. The magnetic assembly of claim 4, wherein the one or more quadrupole assemblies includes a second quadrupole assembly with windings on the angular pole extensions for focusing an electron beam in a second plane, perpendicular to the first plane.

6. The magnetic assembly of claim 5, wherein the second quadrupole assembly further comprises windings for deflecting a focal spot of the electron beam in different directions.

7. An X-ray tube comprising the magnetic assembly of claim 1 for focusing an electron beam extending from a cathode to an anode of the X-ray tube.

8. The X-ray tube of claim 7, wherein tips of the facing pole extensions are substantially equidistant from each other.

9. The X-ray tube of claim 7, wherein angular pole extensions positioned at opposite ends of different opposing members face each other.

10. The X-ray tube of claim 7, wherein the one or more quadrupole assemblies includes a cathode side quadrupole with windings on the angular pole extensions of the cathode side quadrupole for focusing an electron beam in a first plane.

11. The X-ray tube of claim 7, wherein the one or more quadrupole assemblies includes an anode side quadrupole with windings on the angular pole extensions of the anode side quadrupole for focusing an electron beam in a second plane, perpendicular to the first plane.

12. The X-ray tube of claim 11, wherein the anode side quadrupole further comprises windings for deflecting a focal spot of the electron beam in different directions.

13. A magnetic assembly for focusing an electron beam comprising:

one or more quadrupole assemblies, each quadrupole assembly having at least a pair of opposing members with angular pole extensions of one opposing member facing angular pole extensions of another opposing member, wherein the opposing members are C shaped quadrupole cores with the angular pole extensions positioned at ends of the C shaped quadrupole cores.

14. An X-ray tube comprising the magnetic assembly of claim 13 for focusing an electron beam extending from a cathode to an anode of the X-ray tube.

15. A magnetic assembly for focusing an electron beam comprising:

one or more quadrupole assemblies, each quadrupole assembly having at least a pair of opposing members with angular pole extensions of one opposing member facing angular pole extensions of another opposing member, wherein the opposing members are triangular quadrupole cores with truncated ends forming the angular pole extensions.

16. An X-ray tube comprising the magnetic assembly of claim 15 for focusing an electron beam extending from a cathode to an anode of the X-ray tube.

* * * * *